US007325810B2

(12) United States Patent
Henry

(10) Patent No.: US 7,325,810 B2
(45) Date of Patent: Feb. 5, 2008

(54) TANK CONDUIT ORIFICE SEALING DEVICE WITH INTERNAL BOLTS

(76) Inventor: Drew P Henry, 265 Burns Dr., Yuba City, CA (US) 95991

( * ) Notice: Subject to any disclaimer, the term of this patent is extended or adjusted under 35 U.S.C. 154(b) by 125 days.

(21) Appl. No.: 11/101,051

(22) Filed: Apr. 6, 2005

(65) Prior Publication Data

US 2005/0242524 A1 Nov. 3, 2005

Related U.S. Application Data

(60) Provisional application No. 60/560,381, filed on Apr. 6, 2004, provisional application No. 60/570,965, filed on May 13, 2004.

(51) Int. Cl.
*F16L 5/02* (2006.01)
*H02B 1/40* (2006.01)
*H02G 3/22* (2006.01)

(52) U.S. Cl. ..... 277/606; 277/607; 277/616; 248/56; 174/503

(58) Field of Classification Search ..... 277/606, 277/616, 624, 607; 285/139.2, 139.1; 174/481, 174/503; 248/56
See application file for complete search history.

(56) References Cited

U.S. PATENT DOCUMENTS 2,366,442 A * 1/1945 Cunningham ..... 285/200
3,018,078 A * 1/1962 Holdren ..... 248/56
3,654,382 A * 4/1972 Rubright ..... 174/153 G
4,291,905 A * 9/1981 Schrock ..... 285/192
5,056,801 A * 10/1991 Beadle ..... 277/577
5,722,699 A * 3/1998 Brancher ..... 285/142.1
5,961,155 A * 10/1999 Youngs ..... 285/139.1
6,086,117 A * 7/2000 Youngs ..... 285/205

OTHER PUBLICATIONS

Fibrelite, Premier Pipe Entry Kits, Web Catalog, Date Unknown, 4 pages, Skipton, UK.

* cited by examiner

*Primary Examiner*—Alison K Pickard
(74) *Attorney, Agent, or Firm*—Gross & Associates

(57) ABSTRACT

This invention provides a device for use with sealing an orifice in a wall, comprising: a first annular member having an interior radius and a radial mating surface; a second annular member disposed on the first annular member opposite the radial mating surface and being axially aligned with the first annular member; a plurality of mounting portions disposed on the interior radius of the first annular member such that each mounting portion is substantially flush with the radial mating surface, wherein each mounting portion has a fastener orifice; and, an alignment pin disposed on at least one of the plurality of mounting portions, the alignment pin is substantially parallel to an axis of the first annular member. This invention also provides a device for use with sealing orifices wherein the alignment pin includes a spring biased securing end.

18 Claims, 4 Drawing Sheets

FIG. 2
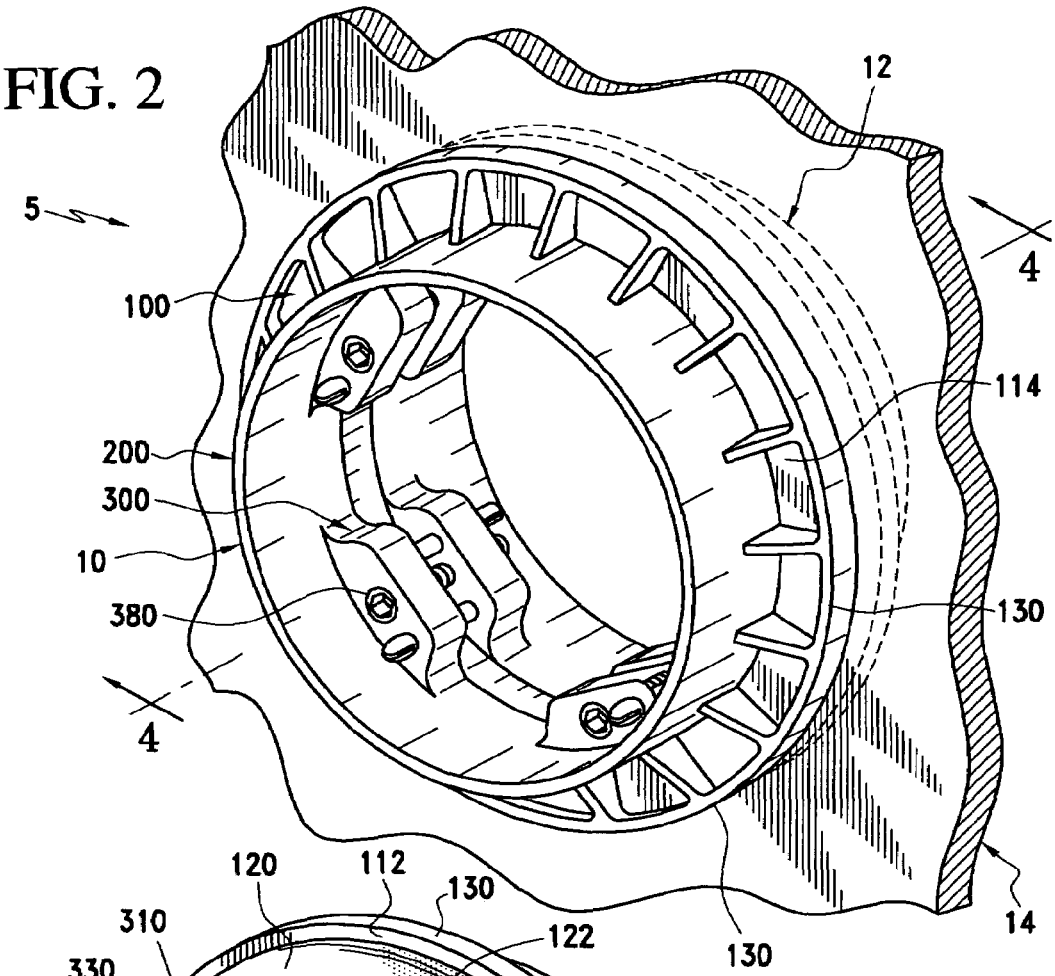
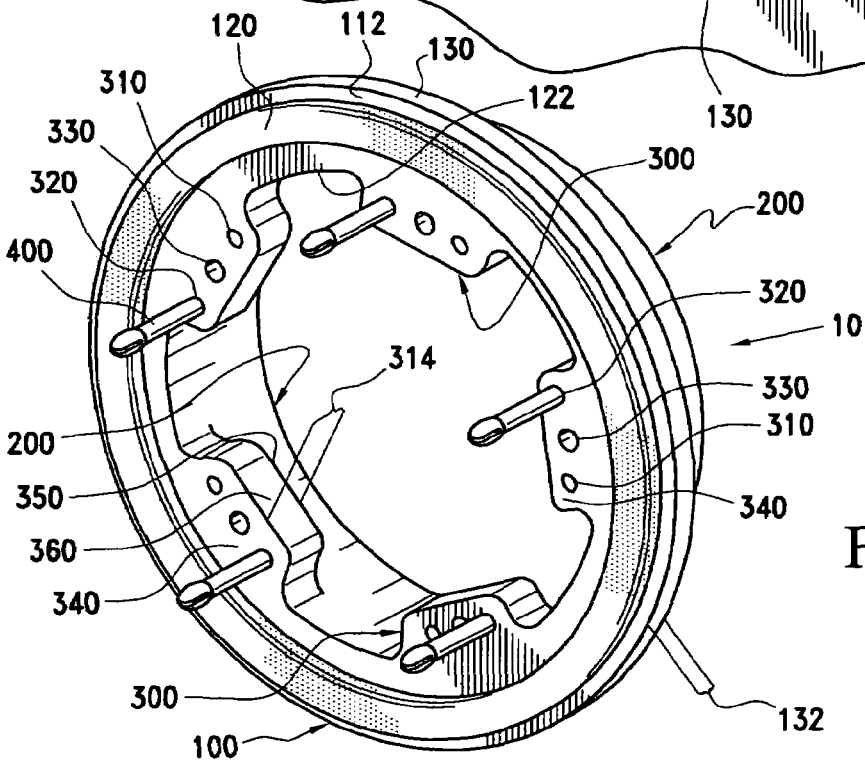
FIG. 1

TANK CONDUIT ORIFICE SEALING DEVICE WITH INTERNAL BOLTS

CROSS REFERENCE TO RELATED APPLICATION

This nonprovisional application claims the benefit of Provisional Application No.: 60/560,381, filed on Apr. 06, 2004 and of Provisional Application No.: 60/570,965 filed on May 13, 2004, both of which are incorporated herein by reference in its entirety and to which priority is claimed.

BACKGROUND OF THE INVENTION

1. Field of Invention

The present invention relates to entrance seals for securing and sealing pipes penetrating through walls of receptacles to prevent leakage.

2. Description of Related Art

Storage tanks are used for a variety of purposes, but mainly to store bulk fluids such as petroleum products like gasoline or diesel fuel. Storage tanks can be located either above or below ground. Further, storage tanks can have a variety of conduits or pipes that penetrate the wall of the tank. Also, dry tanks are often used to house risers from the bulk fuel tanks and these tanks also have pipes that carry fuel and penetrate the wall of the tank. The orifice in the wall of a tank through which a pipe passes must be sealed for two purposes; first to protect the environment outside the tank from leaking fluids; and second to keep the fluid stored inside the tank free from contaminants. Entrance seals for storage tanks above ground, are fairly simple because the tank is steady and the sealing device is easily accessible. Underground storage tanks present a different set of challenges. Since the tank is underground, the tank is susceptible to any movement or settling of the ground. Consequently, an orifice sealing device must provide some flexibility to allow the pipe to flex as the tank shifts. Additionally, once an entrance seal is installed on an underground tank, access to it without excavating the dirt around the tank is limited.

Therefore, the sealing device for underground storage tank orifices must meet the higher demands of being installed in the underground environment. Conventional storage tank sealing devices; however, have several deficiencies. One such deficiency with conventional devices is that the mounting hardware is exposed to both the corrosive elements internal to the storage tank and the external environment especially if the tank is underground. This exposure will eventually cause the mounting hardware to corrode or rust and require replacement.

Conventional entrance seal also have inadequate and inefficient methods of aligning the mounting hardware. Having a tank wall between the two parts of the sealing device, a worker cannot see the mounting hardware on the other side of the wall. This deficiency increases the installation time required.

Still further, conventional sealing devices do not provide a temporary self-securing mechanism to hold the two parts of the device together while the mounting hardware is installed. This deficiency prevents an installer from having both hands free to complete the installation of the sealing device.

Additionally, conventional orifice sealing devices do not provide an efficient and economical means to seal both the interior and the exterior sides of the orifice as may be required by local and/or national laws.

An additional deficiency of conventional sealing devices is that the devices consist of many parts, such as a sleeve or an insert, a gasket, a ring, a boot and mounting hardware. Or a conventional sealing device may have pieces of different design (i.e. male and female parts), where the internal piece and the external piece are different, requiring installers to be very attentive to which part of the device each worker has; for example: the installer outside the tank must have a piece of the device different but corresponding piece of the device the installer inside the tank will have. This level of attentiveness is often lacking; thus increasing the installation time and decreasing efficiency, because if either of the installers have the wrong piece, one must return to the surface to get the required corresponding piece of the sealing device.

As will be apparent from the description below the present invention will overcome the noted deficiencies of the prior art.

SUMMARY OF THE INVENTION

It is an object of the present invention to overcome the drawbacks and shortcomings of conventional storage tank conduit orifice sealing devices. Many conventional tank sealing devices have mounting hardware that is exposed to the corrosive environment of the tank interior or the moist ground outside the tank. This present invention provides the capability to protect the mounting hardware from corrosion, internally and externally, thereby allowing the sealing boot to remain in service longer. This is accomplished by providing a sealing boot mounting area on the device itself with the mounting hardware internal to the device and the sealing boot. An additional feature of this device is that the substance contained in the tank, fluid or gas, is prevented from leaking to the outside environment.

The unique alignment device provided by this invention allows for the quick mating of two devices made in accordance with this invention. Once an installer on the outside of a tank has placed a device made in accordance with this invention on the exterior of a tank, the installer on the inside can complete the job alone.

Additionally, the alignment device serves as temporary securing device while an installer is fastening the mounting hardware. The present invention incorporates a built-in mechanism aid in the alignment of the device.

This invention further provides the capability to install seals internal and external to a storage tank, thereby double sealing the orifice.

Another feature of this invention, which reduces installation time, is a fastener cavity to hold the nut of the mounting hardware. The fastener cavity reduces the tool requirement for the installation procedure by holding a securing nut in place while the securing bolt is tighten. These features reduce installation time saving valuable man-hours of work.

Further, underground storage tanks are subject to the earth that they are installed in, as the ground moves so does the tank and or any attached conduits. The present invention, while maintaining the above features allows for the movement of the tank and or conduit.

This invention overcomes the drawbacks and shortcomings of the prior art conventional devices and systems.

This invention provides a device for use with sealing an orifice in a wall, comprising: a first annular member having an interior radius and a radial mating surface; a second annular member disposed on the first annular member opposite the radial mating surface and being axially aligned with the first annular member; a plurality of mounting portions disposed on the interior radius of the first annular member such that each mounting portion is substantially flush with the radial mating surface, wherein each mounting portion has a fastener orifice; and, an alignment pin disposed on at least one of the plurality of mounting portions, the alignment pin is substantially parallel to an axis of the first annular member.

This invention also provides a device for use with sealing orifices comprising: a first annular member having an interior radius and a radial mating surface; a second annular member disposed on the first annular member opposite the radial mating surface and being axially aligned with the first annular member; a plurality of mounting portions disposed on the interior radius of the first annular member such that each mounting portion is substantially flush with the radial mating surface, wherein each mounting portion has a fastener orifice; and, a rod affixed to each mounting portion, wherein the rod is substantially parallel to an axis of the first annular member, the rod includes a spring biased securing end.

This invention further provides a system for use with sealing an orifice in a wall, comprising a first device having a first annular member having an interior radius and a radial mating surface, a second annular member disposed on the first annular member opposite the radial mating surface and being axially aligned with the first annular member, a plurality of mounting portions disposed on the interior radius of the first annular member such that each mounting portion is substantially flush with the radial mating surface, wherein each mounting portion has a fastener orifice and an alignment orifice, and an alignment pin disposed on at least one of the plurality of mounting portions, the alignment pin is substantially parallel to an axis of the first annular member; and, a second device being identical to the first device, wherein when the device is in use the first device is disposable and axially alignable with the orifice in the wall on a first side of the wall and the second device is disposable and axially alignable with the orifice in the wall on an opposing second side of the wall, wherein the respective radial mating surfaces are disposable against the opposing first and second sides of the wall, and wherein the alignment pin of each of the first and second device align with the opposing alignment receiving orifices of the other respective first and second device on the opposing side of the wall.

These and other features and advantages of this invention are described in, or are apparent from, the following detailed description of various exemplary embodiments of the devices and methods according to this invention.

BRIEF DESCRIPTION OF THE DRAWINGS

Various exemplary embodiments of this invention will be described in detail, with reference to the following figures, wherein;

FIG. 1 is a perspective view of a device according to this invention;

FIG. 2 is a perspective view of an assembled system according to this invention;

DETAILED DESCRIPTION OF THE PREFERRED EMBODIMENTS

FIG. 1 is a perspective view of a device 10, made in accordance with this invention and FIG. 2 is a perspective view of an assembled system 5, made in accordance with this invention. It should be appreciated that the assembled system 5 comprises the device 10 and a second attachment member 12. In this exemplary embodiment, the second attachment member 12 is identical to the device 10. In this exemplary embodiment, the assembled system 5 provides for sealing a storage tank from both the inside and the outside. It should be appreciated that in other various exemplary embodiments, the second attachment member could be but is not limited to a plate or any attachment device operably configured to correspond to the mounting hardware on the device 10.

Figure 3:
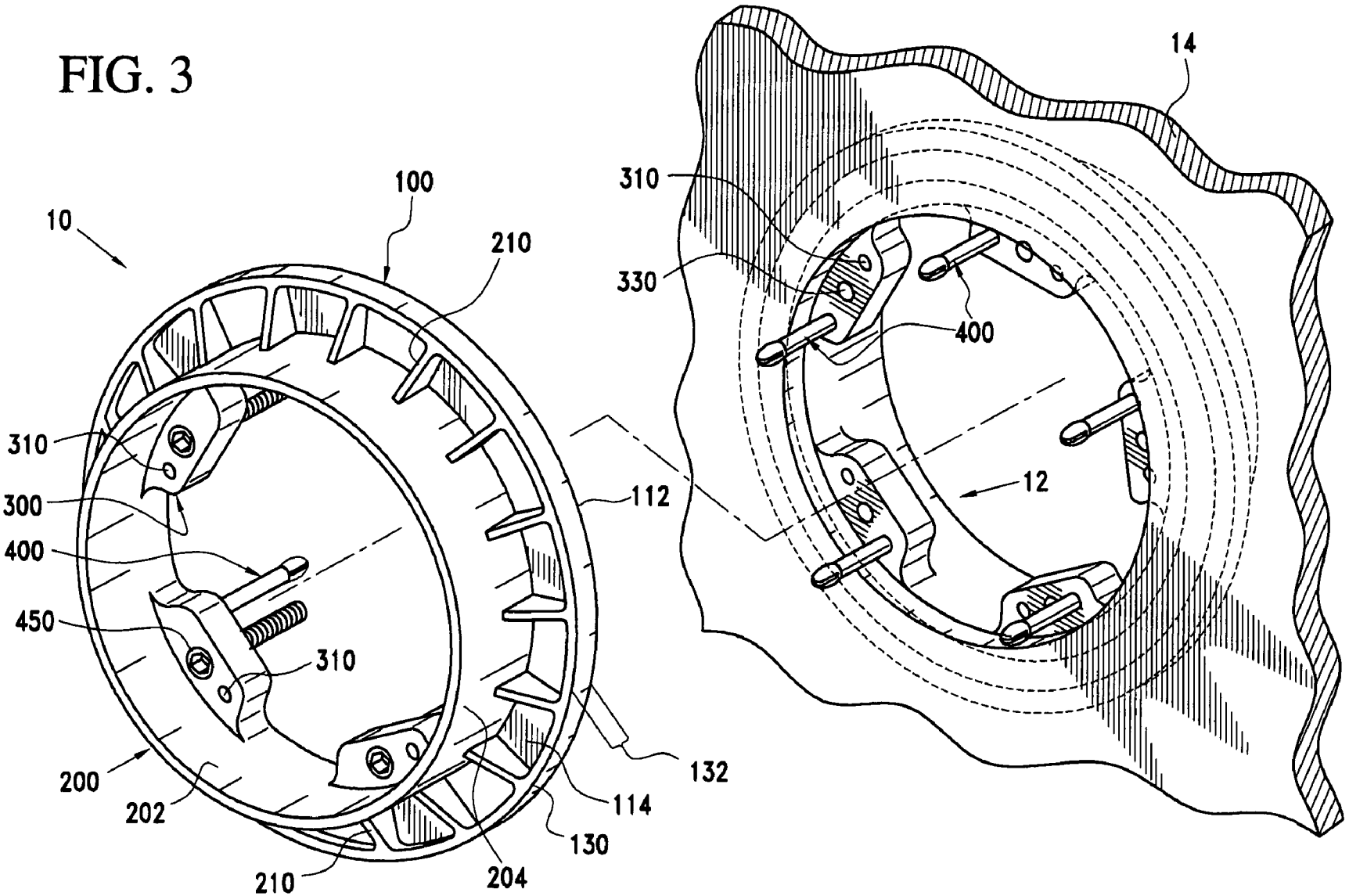
FIG. 3 is a exploded perspective view of the system of FIG. 2.
Figure 4:
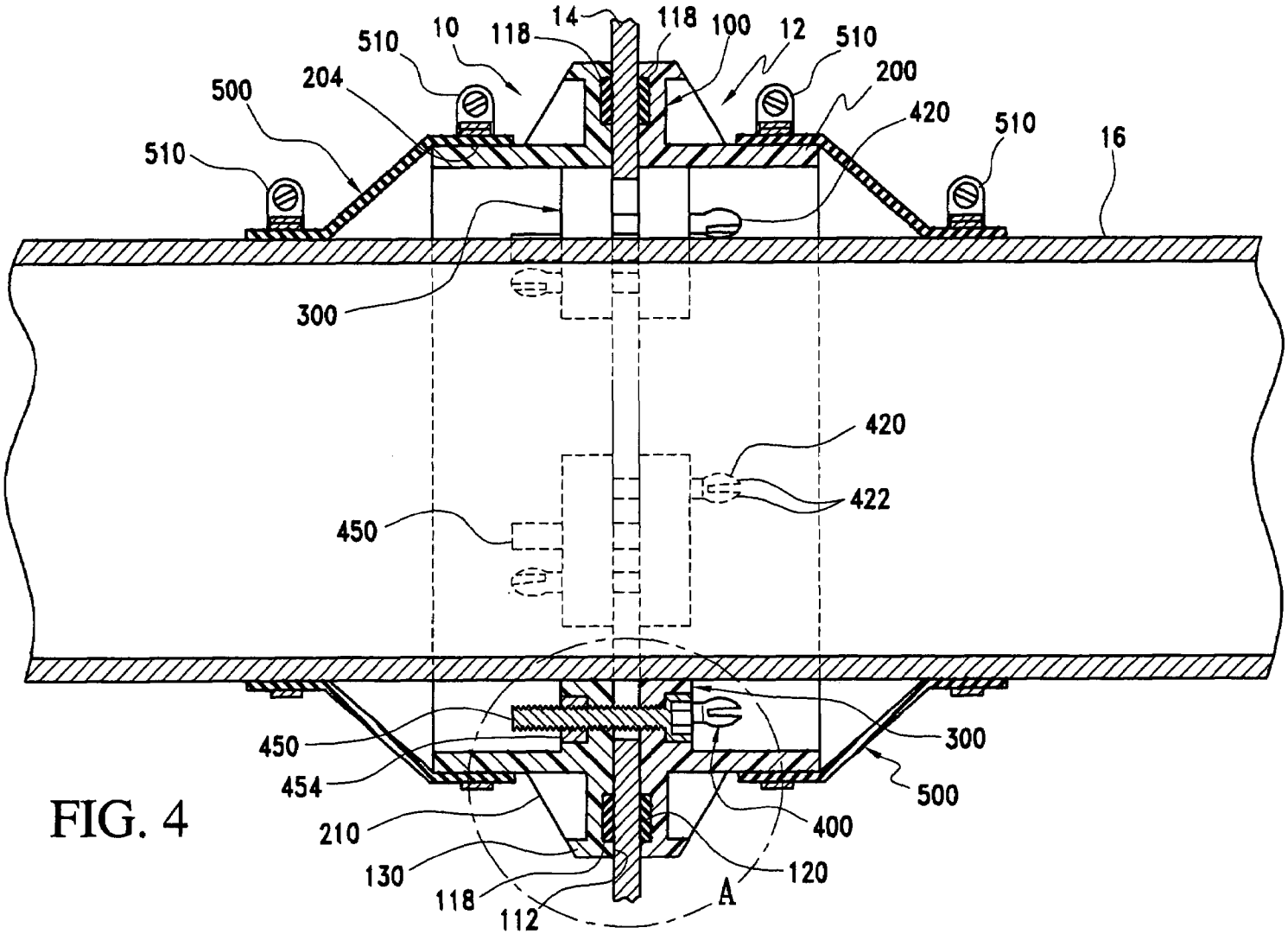
FIG. 4 is a cross-sectional view of the assembled system device taken along line 4-4 in FIG. 2.

The device 10 is an conduit orifice sealing device or pipe entrance seal device for use in tanks or containers that have conduits or pipes, shown in FIG. 4, penetrating the outer structure or wall of a tank 14. The device 10 is designed to be used on one conduit 16 and provides several functions, some of these functions include the capability to seal an orifice through which conduit 16 passes and capability for the conduit 16 passing through a tank wall 14 to be non-perpendicular to the tank surface. In addition to providing these and other functions, the device 10 made in accordance with this invention also provides an alignment feature, a mechanism to temporary secure the device 10 in place during installation and protection to the mounting hardware from corrosive elements inside a tank. Furthermore, when the device 10 is used with another device 12 on the other side of wall structure 14, as shown in FIGS. 2 through 8 as the assembled system 5, the function of protecting the mounting hardware from the corrosive elements outside the tank is also provided.

The device 10 as shown in FIGS. 1 through 8 includes a first member 100, a second member 200 and a plurality of a mounting portions 300. Additionally, in this exemplary embodiment, the first and second members, 100 and 200, and the mounting portions 300 of the device are constructed of one integral piece of material. It should be appreciated that in other various exemplary embodiments the first and second members and the mounting portions of the device could be constructed of individual units or a combination thereof The device 10 is generally constructed out of a substantially rigid material such as but not limited to a harden plastic. It should be appreciated that in other various exemplary embodiments the device could be constructed out of other substantially rigid materials; for example, metal, a synthetic compound or a metal-synthetic compound as is common in the art of sealing devices.

The first member 100 is preferred to have a generally annular ring shape. Referring to FIGS. 1 through 4, the first member or first annular ring 100 includes a mating surface 112, wherein the mating surface 112 includes an annular channel 118, a sealing member 120 and a rim 130. The first member 100, which can also be referred to as the first annular ring, further includes a second surface 114. In addition, the first member 100 includes a thickness 116 (shown in FIG. 5), and an inner radius surface 122.

Figure 5:
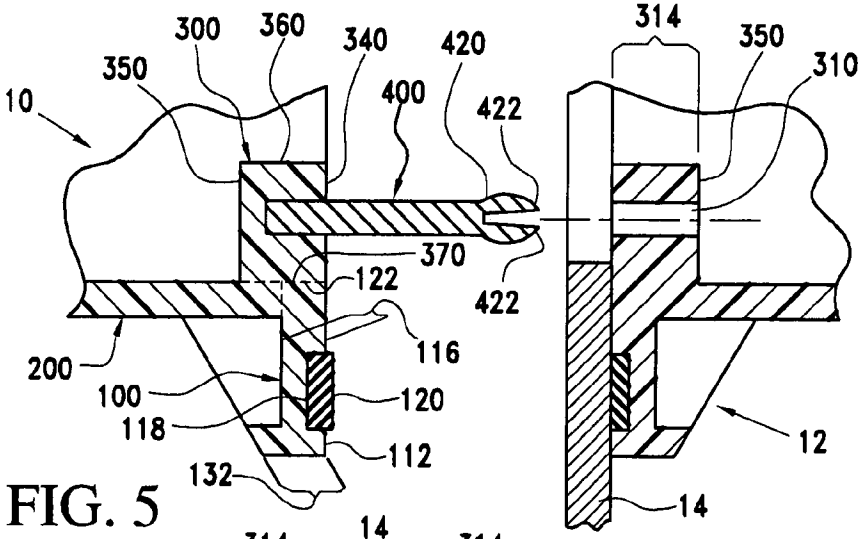
FIG. 5 is a cross-sectional view of an alignment device prior to insertion into a corresponding device according to this invention.

As shown in FIGS. 1 through 4, the mating surface 112 and the second surface 114 are disposed on the first member 100 such that they are perpendicular to the axis of the first annular ring 100. The mating surface 112 is the portion of the device 10 that will come in contact with the wall 14 when the device 10 is installed. The annular channel 118 disposed on the mating surface 112, as shown in FIG. 5, and is operably configured to receive the sealing member 120.

The sealing member or sealing gasket 120 engages the annular channel 118 is generally constructed out of a substantially flexible material. In this embodiment, the sealing member 120 is made out of pellethane. It should be appreciated that in other various exemplary embodiments, the sealing member could be made out of other flexible material common to the art of gaskets. Further, it should be appreciated that in other various exemplary embodiments, the sealing gasket could be constructed with additional sealing ribs on the sealing gasket.

The outer rim 130 has a rim height 132. In this embodiment, the rim height 132 is greater then the thickness 116 as shown in FIG. 5. It should be appreciated that in other various exemplary embodiments the rim height could be about equal to the thickness.

Now referring to the second member or second annular ring 200 of the device 10, as shown in FIG. 3. The second annular ring 200 includes inner and outer surfaces 202 and 204 respectively, wherein the inner and outer surfaces 202 and 204 are parallel to the axis of the second annular ring.

The second annular ring 200 is disposed such that it is substantially perpendicular to the second surface 114 of the first annular ring 100 and the first and second annular rings 100 and 200 are coaxially aligned. Additionally, the second annular ring 200 is further positioned such that the inner surface 202 is substantially flush with the inside radius 122 of the first annular ring.

Referring to FIG. 3, the second annular ring 200 is includes a plurality of strengthening tabs 210. The strengthening tabs 210 are positioned about the circumference of the outer surface 204 of the second annular ring 200. In this exemplary embodiment, each strengthening tab 210 is disposed such that each strengthening tab 210 is substantially perpendicular to both the second surface 114 of the first annular ring 100 and the outer surface 204 of the second annular ring 200. Further, each strengthening tab 210 is disposed approximately at the top of the rim height 132 and ends approximately at the midway point of the outer surface 204. It should be appreciated that in other various exemplary embodiments, the use of the strengthening tabs are optional. Further, in this exemplary embodiment, each strengthening tab 210 is an integral part of the device 10; but, it should be appreciated that in other various exemplary embodiments, the strengthening tabs could be non-integral units installed on the device.

Referring again to FIG. 1, in this embodiment the device 10 includes five mounting portions or mounting tabs 300. It should be appreciated that in other various exemplary embodiments, the device is configured with either more or less mounting tabs. Each mounting tab 300 provides a mounting structure in which the device 10 is secured to the wall 14.

Each mounting tab 300 is includes an alignment pin receiving orifice 310, an alignment pin support orifice 320, a fastener orifice 330 and a tab thickness 314. Further, it is preferred that each mounting tab 300 be constructed out of the same material as the device 10. In the preferred embodiment, each mounting tab 300 is an integral part of the device 10. However, it should be appreciated that in other various exemplary embodiments each mounting tab could be individual units affixed to the device.

Figure 8:
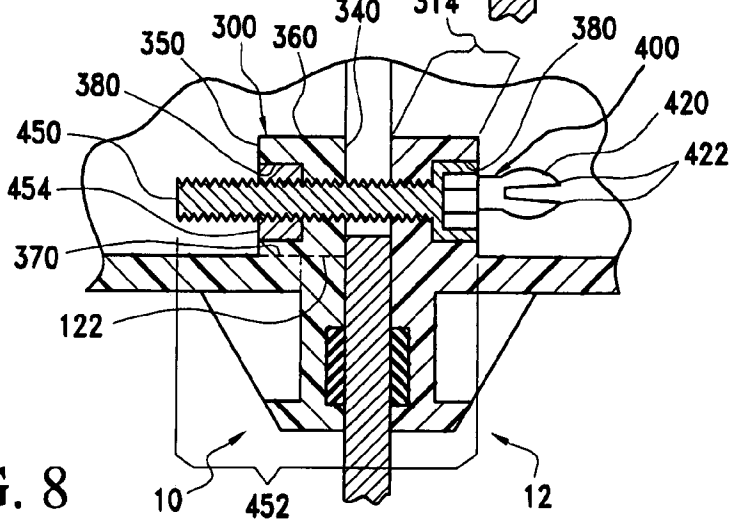

Referring again to FIG. 5, the mounting tab 300, further includes a bottom surface 340, a top surface 350, an inside surface 360 and an outside surface 370. A fastener cavity 380 is disposed on the top surface 350, as shown in FIG. 8. It is preferred that the fastener cavity 380 be disposed on the top surface 350 such that the cavity 380 is about one half the mounting tab thickness 314 as shown in FIG. 8. Each mounting tab 300 is disposed on the inner radius mating surface 112 of the first annular ring 100 such that each mounting tab bottom surface 240 is substantially flush with the inner radius mating surface 112.

It is preferred that the alignment pin receiving orifice 310 and the fastener orifice 330 penetrate through the mounting tab thickness 314 as shown in FIGS. 5 through 8.

Each mounting tab 300 is further configured to operably support an alignment member or alignment pin 400 as shown in FIGS. 5 through 8. The alignment pin 400 includes a length 410, a securing end 420 and a plurality of tines or prongs 422.

Figure 6:
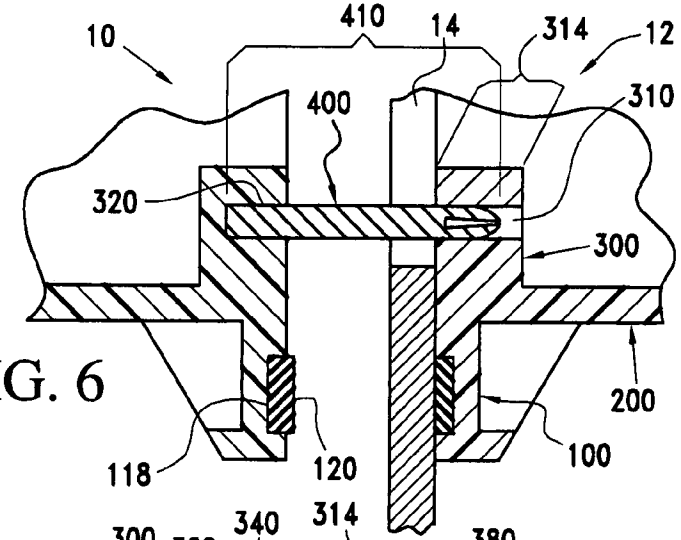
FIG. 6 is a cross-sectional view of the alignment device of FIG. 5 partially inserted into the corresponding device according to this invention.
Figure 7:
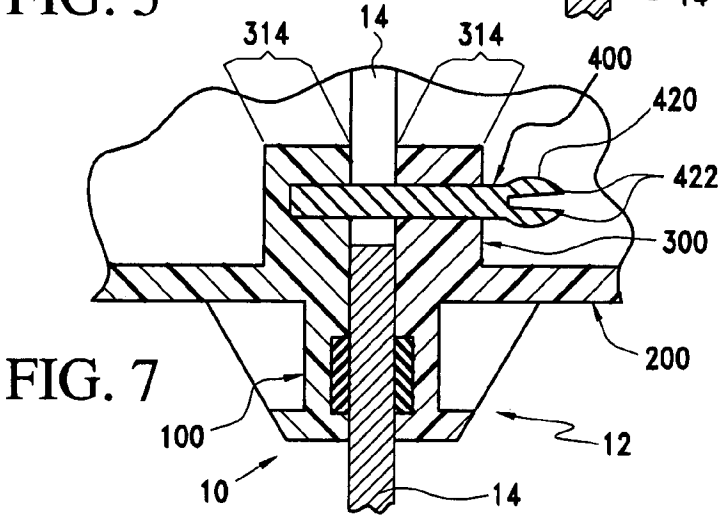
FIG. 7 is a cross-sectional view of the alignment device of FIG. 5 fully engaged with the corresponding device according to this invention; and, FIG. 8 is a cross-sectional view of a mounting bolt and nut locking mechanism of Detail A in FIG. 4 according to this invention.

The alignment pin 400 is disposed on the mounting tab 300 by the placement of the alignment pin 400 into the alignment pin support orifice 320. As shown in FIGS. 5 through 7, the alignment pin 400 in this exemplary embodiment is a separate component incorporated into the alignment support orifice 320. It should be appreciated that in other various exemplary embodiments, the alignment pin is an integral part of the mounting tab. Additionally, as shown in FIGS. 5 through 7, the alignment pin support orifice 320 is operably configured to receive the alignment pin 400 and the alignment pin support orifice 320 does not penetrate the mounting tab thickness 314. It should be appreciated that in other various exemplar embodiments, the alignment pin support orifice and the alignment pin do penetrate through the mounting tab thickness.

Referring again to FIGS. 5 through 7, the alignment pin 400 is operably configured to connect the device 10 to the second attachment member 12 in the correct alignment for the mounting hardware and to temporarily secure the device 10 to the second attachment member 12.

The length 410 of the alignment pin 400 is preferred to be greater then the twice the mounting tab thickness 314 plus the tank 14 thickness. Additionally, the alignment pin 400 is engages the alignment pin receiving orifice 310 of an opposing device.

Still referring to FIGS. 5 through 7, the securing end 420 of the alignment pin 410 includes a plurality of tines or prongs 422, as shown. It is preferred in this exemplary embodiment that the securing end 420 includes two prongs 422. The prongs 422 are operably configured with a preloaded repelling spring bias. It is preferred that the prongs 422 form a bulbous head with a center cutout, wherein the bulbous head compresses upon insertion into a corresponding orifice and relaxes once it is fully inserted as will be discussed below. It is preferred that the enter cutout be about twice the length of the head to provide adequate flex of the prongs.

The sequence of FIGS. 5 through 7 show how the alignment pin 400 engages the alignment pin receiving orifice 310. As the prongs 422 enter the alignment pin receiving orifice 310 the prongs 422 are compressed, as shown in FIG. 6. Once the prongs 422 and the securing end 420 exit the alignment pin receiving orifice 310 on the mounting tab surface 350 of the second attachment member 12, as shown in FIG. 7, the pre-loaded repelling bias forces the prongs 422 apart and the securing end 420 provides a temporary securing mechanism for the device 10. It should be appreciated that in other various exemplary embodiments, the prongs could incorporate other securing devices, such as but not limited to barbs, to provide an alternative securing mechanism.

Now referring to FIGS. 2, 3, 4 and 8, the device 10 is secured to the second attachment member 12 and the tank wall 14 by use of a plurality of fasteners 450 (as shown in FIG. 8). In this exemplary embodiment it is preferred that the fastener 450 be a socket screw. It should be appreciated that in other various exemplary embodiments the fastener could be any round head bolt common in the art of fasteners. The fastener 450 has a length 452, such that the length 452 of the fastener 450 is generally greater then the twice the mounting tab thickness 314 plus the tank wall 14 thickness.

Further, the fastener 450 is operably configured to receive a fastener nut 454. Additionally, the fastener securing cavity 380 is operably configured to receive and hold the fastener nut 454. It is preferred in this exemplary embodiment that the fastener nut 454 is a hex head nut. However, it should be appreciated that in other various exemplary embodiments, the fastener nut as well as the matching fastener securing cavity could be of other designs such as common to the art of fasteners.

Referring back to FIG. 3, the device 10 is placed on one side of the wall 14 with an orifice and the second attachment member 12 is operably disposed on the opposite side of the wall 14 such that the plurality of alignment pins 400 of the device 10 correspond to the plurality of alignment pin receiving orifices 310 on the second attachment member 12. Further, the plurality of alignment pins 400 of the second attachment member 12 correspond to the plurality of alignment pin receiving orifices 310 on the device 10. When this alignment is made, the fasteners 450 are in line with the fastener orifices 330 of the opposite mounting tab 300

As shown in FIGS. 5 through 8, as the plurality of alignment pins 400 pass through the plurality of alignment pin receiving orifices 310, the plurality of prongs 450 expand and temporarily secure the device 10 and the second attachment member 12 into place. An installer then places a plurality of fasteners 450 into the plurality of fastener orifices 330 on the device 10 and places a plurality of fastener nuts 454 into the fastener securing cavities 380 on the second attachment member 12. Then, using an appropriate tool for the fastener 450, the installer can tighten the fasteners 450. As the fasteners 450 are tighten, the gasket 120 will be compressed against the wall of the tank 14 providing a seal between the device 10 and the tank 14. It should be appreciated that in other various exemplary embodiments, the fasteners could be applied from the second attachment member vice the device.

Now referring to FIG. 4, the device 10 and the assembled system 5 further include a plurality of rubber boots 500. The outer surface 204 of the second annular ring 200 is operably configured to receive the rubber boot 500. Additionally, the rubber boot 500 is operably configured to receive the outer surface of the conduit 16 as shown in FIG. 4. In this exemplary embodiment, the assembled system 5 includes device 10, the second attachment member 12, which is an identical device 10 and two rubber boots 500. When the rubber boots 500 are installed as shown in FIG. 4, the assembled system 5 provides sealing on both the internal and external sides of the tank 14 and seal around the pipe 16. The rubber boots 500 are secured in place by a plurality of clamping devices 510. It is preferred that clamping device be a hose clamp, however, it should be appreciated that in other various exemplary embodiments other clamps or securing devices, such as for example zip ties, common in the art may be used.

The inclusion of the rubber boot 500 provides for the device 10 an enclosed environment such that mounting hardware is protected from any corrosive element that may be in the tank 14. Additionally, the combination of the device 10 and the mounting boot 500 prevents any of the contents of the tank 14 from escaping and keeps the atmosphere outside of the tank 14 from entering.

While the device 10 described above includes a combination of identical devices or the assembled system 5 made in accordance with this invention, it should be appreciated that in other various exemplary embodiments, the system could be composed of one device 10 and a second attachment member 12 such as but not limited to a blank plate or a ring configured with corresponding orifices.

Additionally, it should be appreciated that in other various exemplary embodiments the device could have application for any storage container underground, aboveground or underwater.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of this invention.

What is claimed is:

1. A device for use with sealing an orifice in a wall, comprising:

a first annular member having an interior radius and a radial mating surface, wherein the radial mating surface has an annular channel operably configured to receive a seal;

a second annular member disposed on the first annular member opposite the radial mating surface and being axially aligned with the first annular member;

a plurality of mounting portions disposed on the interior radius of the first annular member such that each mounting portion is substantially flush with the radial mating surface, wherein each mounting portion has a fastener orifice; and, an alignment pin disposed on at least one of the plurality of mounting portions, wherein the alignment pin is substantially parallel to an axis of the first annular member.

2. The device as recited in claim 1, further comprising a seal disposed in the annular channel.

3. The device as recited in claim 1, wherein the second annular member is a boot mounting surface operably configure to receive a sealing boot.

4. The device as recited in claim 3, further comprising a sealing boot disposed on the boot mating surface of the second annular member.

5. The device as recited in claim 1, wherein the alignment pin includes a securing end having a plurality of securing prongs.

6. The device as recited in claim 1, wherein each of the mounting portions includes an alignment pin receiving orifice and a fastener securing cavity.

7. The device as recited in claim 1, wherein the alignment pin is operably configured to engage an alignment pin receiving orifice of another device disposed on an opposing side of the orifice in the wall.

8. A device for use with sealing orifices comprising:

a first annular member having an interior radius and a radial mating surface and, wherein the radial mating surface includes an annular channel and further comprising a seal disposed in the annular channel;

a second annular member disposed on the first annular member opposite the radial mating surface and being axially aligned with the first annular member;

a plurality of mounting portions disposed on the interior radius of the first annular member such that each mounting portion is substantially flush with the radial mating surface, wherein each mounting portion has a fastener orifice; and, a rod affixed to each mounting portion, wherein the rod is substantially parallel to an axis of the first annular member, and the rod includes a spring biased securing end.

9. The device as recited in claim 8, wherein the spring biased securing end includes a plurality of securing prongs.

10. The device as recited in claim 8, wherein the spring biased securing end has a generally bulb shape.

11. The device as recited in claim 8, wherein the second annular member includes a mounting shoulder operably configured to receive a sealing boot.

12. The device as recited in claim 8, wherein each of the mounting portions includes a fastener cavity and a rod receiving orifice.

13. The device as recited in claim 8, wherein the rod is operably configured to engage an alignment receiving orifice of another device disposed on an opposing side of a orifice in a wall.

14. A system for use with sealing an orifice in a wall, comprising:

a first device having a first annular member having an interior radius and a radial mating surface, a second annular member disposed on the first annular member opposite the radial mating surface and being axially aligned with the first annular member, a plurality of mounting portions disposed on the interior radius of the first annular member such that each mounting portion is substantially flush with the radial mating surface, wherein each mounting portion has a fastener orifice and an alignment orifice, and an alignment pin disposed on at least one of the plurality of mounting portions, the alignment pin is substantially parallel to an axis of the first annular member; and, a second device being identical to the first device, wherein when the device is in use the first device is disposable and axially alignable with the orifice in the wall on a first side of the wall and the second device is disposable and axially alignable with the orifice in the wall on an opposing second side of the wall, wherein the respective radial mating surfaces are disposable against the opposing first and second sides of the wall, and wherein the alignment pin of each of the first and second device align with the opposing alignment receiving orifices of the other respective first and second device on the opposing side of the wall.

15. The system as recited in claim 14, wherein the radial mating surface of each device has an annular channel operably configured to receive a seal member.

16. The system as recited in claim 14, wherein the alignment pin of each the first and second devices has a securing end, wherein the securing end is operably configured with a plurality of securing prongs.

17. The system as recited in claim 14, wherein the plurality of mounting portions of each the first and second devices has a plurality of fastener securing cavities axially aligned with the respective fastener orifices.

18. The system as recited in claim 14, further comprising a sealing boot disposed on the second annular member of each of the first and second devices.

* * * * *